US008866682B1

(12) United States Patent
Baskinger, Jr.

(10) Patent No.: US 8,866,682 B1
(45) Date of Patent: Oct. 21, 2014

(54) COMPOSITE FORWARD COLDPLATE FOR A PHASED ARRAY RADAR ASSEMBLY

(75) Inventor: George J. Baskinger, Jr., Mount Laurel, NJ (US)

(73) Assignee: Lockheed Martin Corporation, Bethesda, MD (US)

( * ) Notice: Subject to any disclaimer, the term of this patent is extended or adjusted under 35 U.S.C. 154(b) by 351 days.

(21) Appl. No.: 13/464,185

(22) Filed: May 4, 2012

Related U.S. Application Data

(60) Provisional application No. 61/487,524, filed on May 18, 2011.

(51) Int. Cl.
*H01Q 1/00* (2006.01)
*H01Q 1/42* (2006.01)

(52) U.S. Cl.
USPC ..... 343/720; 343/872; 343/853; 343/893

(58) Field of Classification Search
None
See application file for complete search history.

(56) References Cited

U.S. PATENT DOCUMENTS

| | | | | |
|---|---|---|---|---|
| 3,818,386 | A * | 6/1974 | Granberry | 333/33 |
| 4,771,294 | A * | 9/1988 | Wasilousky | 343/853 |
| 5,460,317 | A | 10/1995 | Thomas et al. | |
| 5,745,076 | A * | 4/1998 | Turlington et al. | 342/372 |
| 6,005,531 | A * | 12/1999 | Cassen et al. | 343/853 |
| 7,508,338 | B2 * | 3/2009 | Pluymers et al. | 342/175 |
| 7,889,147 | B2 * | 2/2011 | Tam et al. | 343/777 |
| 2012/0146862 | A1 * | 6/2012 | Danello et al. | 343/720 |
| 2012/0212175 | A1 * | 8/2012 | Sharaf et al. | 320/107 |

* cited by examiner

*Primary Examiner* — Trinh Dinh
(74) *Attorney, Agent, or Firm* — Howard IP Law Group, PC

(57) ABSTRACT

A coldplate assembly for a phased array antenna has a first coldplate having one or more internal coolant channels and one or more interlocking members disposed at side edges thereof; and a second coldplate having one or more internal coolant channels and one or more interlocking members disposed at side edges thereof. The one or more interlocking members of the first coldplate interlock with the one or more interlocking members of the second coldplate.

18 Claims, 12 Drawing Sheets

COMPOSITE FORWARD COLDPLATE FOR A PHASED ARRAY RADAR ASSEMBLY

CROSS-REFERENCE TO RELATED APPLICATIONS

This application claims priority under 35 U.S.C. §119(e) to Provisional Patent Application Ser. No. 61/487,524 entitled "Composite Forward Coldplate for a Radar Array Assembly and other Monolithic Structures" filed May 18, 2011, the subject matter thereof incorporated by reference in its entirety.

FIELD OF INVENTION

The present disclosure relates to phased antenna arrays. More particularly, the present disclosure relates to a composite forward coldplate assembly used for cooling electronic components of an antenna array.

BACKGROUND

Modern electronic systems, including radar systems, often utilize high-power electronic components which generate large amounts of heat during operation. In order to prevent damage and extend the service life of these components, separate conductive cooling systems are often implemented into these systems. These cooling systems may comprise, for example, heat sinks or heat exchangers embodied as heat-conducting frames, or "coldplates", which may be air or liquid-cooled, or may simply comprise a large thermal capacity. The electronic components are generally placed into conductive contact with these coldplates in order to provide efficient cooling.

When implemented into a typical radar antenna array, these coldplate assemblies require exacting dimensional stability and accuracy in order to function properly. As shown in FIG. 1, an existing forward coldplate assembly 100 configured for use in a radar system includes a plurality of forward coldplates 110 mounted to a large, single planar forward faceplate 120. The coldplate assembly 100 is one of the structural components of the radar array antenna and also serves as a cooling device and an interface for many primary components of the radar array antenna. Examples of these primary components include, without limitation, forward radar components such as radiator tiles and electronic processing equipment.

Each coldplate 110 comprises one or more trenches formed in a surface thereof, and a plurality of covers welded thereto. The covers close the trenches so as to define coolant channels in the coldplate for circulating coolant therethrough. The coldplates are manufactured by milling a plurality of trenches into a sheet of metal which forms the forward coldplate. After milling has been completed, the metal covers are, for example, friction-stir welded to the surface of the coldplate to close the trenches formed therein. After welding of the covers to the forward coldplates, the forward coldplates are mounted to the forward faceplate, which is required for connecting each of the forward coldplates to one another. The faceplate also serves as a mounting surface for the forward radar equipment mentioned earlier. As set forth above, the forward coldplates 110 of the forward coldplate assembly 100 may be difficult to manufacture because they require exacting dimensional stability in order to function properly. More specifically, the heat and/or pressure generated by the friction-stir welding process can cause the forward coldplates to warp.

Attempts have been made to produce a single large forward coldplate that is generally the size of the forward faceplate, thereby eliminating the need for the forward faceplate. However, in addition to being relatively difficult to machine, and often costly, the friction-stir welding process causes such a large forward coldplate to warp significantly. Therefore, forward coldplate assemblies continue to be manufactured with a plurality of smaller forward coldplates mounted to a larger forward faceplate assembly.

Accordingly, a forward coldplate assembly that eliminates the forward faceplate and has improved dimensional tolerances, dimensional stability and thermal conductivity, is desired.

SUMMARY

A method is disclosed for making a coldplate assembly for use in a phased array antenna. The method includes providing a first coldplate including one or more internal coolant channels and one or more interlocking members disposed at an edge thereof. A second coldplate is provided, also including one or more internal coolant channels and one or more interlocking members disposed at an edge thereof. One or more interlocking members of the first coldplate are engaged with the one or more interlocking members of the second coldplate to interlock the first coldplate with the second coldplate.

Also disclosed is a coldplate assembly for an active array antenna. The coldplate assembly comprises a first coldplate including one or more internal coolant channels and one or more interlocking members disposed at an edge thereof, and a second coldplate including one or more internal coolant channels and one or more interlocking members disposed at an edge thereof. The one or more interlocking members of the first coldplate interlock with the one or more interlocking members of the second coldplate.

Further disclosed is an active array antenna. The antenna comprises a coldplate assembly, and an antenna array disposed a first side of the coldplate assembly. The coldplate assembly includes a first coldplate including one or more internal coolant channels and one or more interlocking members disposed at an edge thereof, a second coldplate including one or more internal coolant channels and one or more interlocking members disposed at an edge thereof. The one or more interlocking members of the first coldplate interlocks with the one or more interlocking members of the second coldplate.

DETAILED DESCRIPTION

Figure 1:
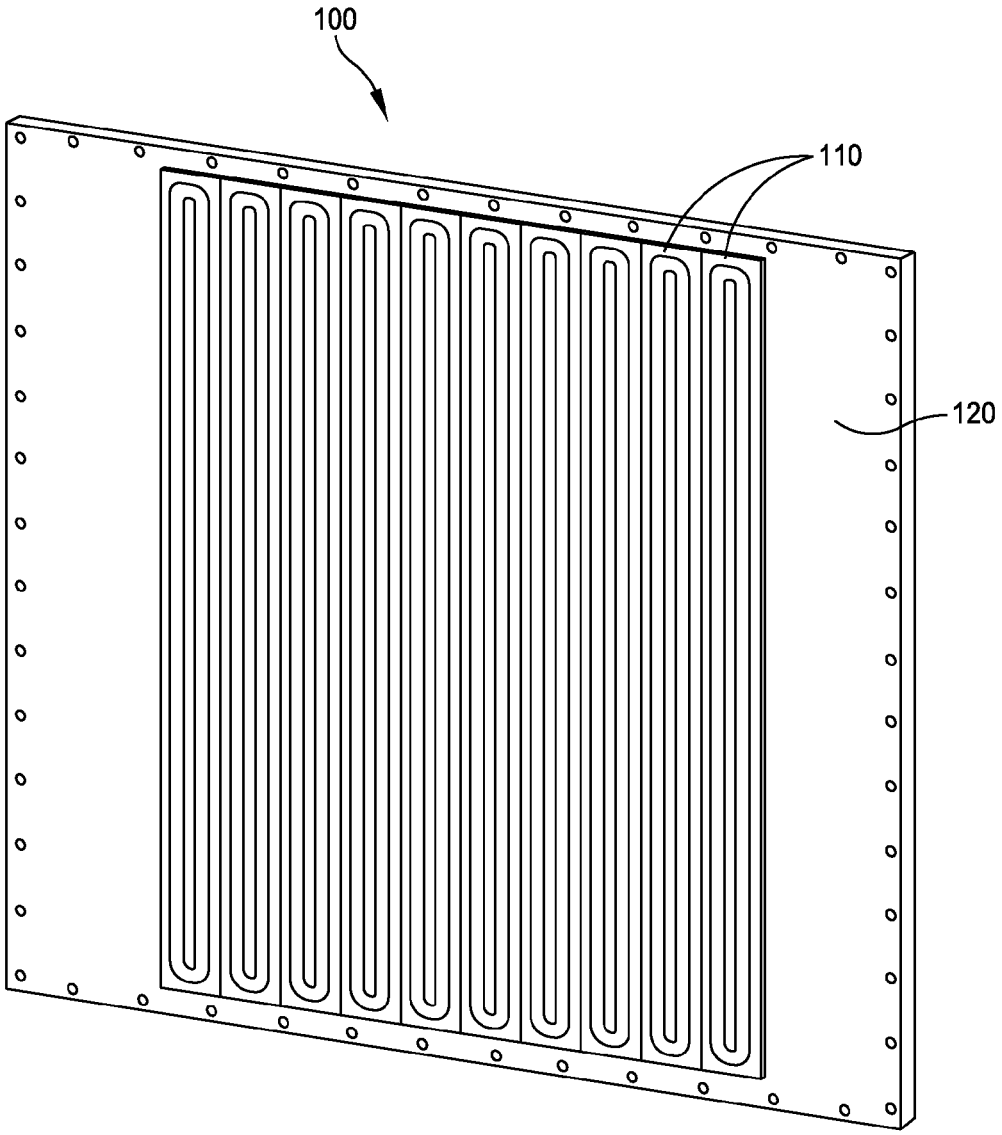
FIG. 1 (PRIOR ART)
FIG. 1 is a perspective view of a prior art coldplate assembly.

It is to be understood that the figures and descriptions of the present invention have been simplified to illustrate elements that are relevant for a clear understanding of the present invention, while eliminating, for purposes of clarity, many other elements found in radar antenna arrays and/or electronic cooling systems utilizing coldplates. However, because such elements are well known in the art, and because they do not facilitate a better understanding of the present invention, a discussion of such elements is not provided herein. The disclosure herein is directed to all such variations and modifications known to those skilled in the art.

In the following detailed description, reference is made to the accompanying drawings that show, by way of illustration, specific embodiments in which the invention may be practiced. It is to be understood that the various embodiments of the invention, although different, are not necessarily mutually exclusive. Furthermore, a particular feature, structure, or characteristic described herein in connection with one embodiment may be implemented within other embodiments without departing from the scope of the invention. In addition, it is to be understood that the location or arrangement of individual elements within each disclosed embodiment may be modified without departing from the scope of the invention. The following detailed description is, therefore, not to be taken in a limiting sense, and the scope of the present invention is defined only by the appended claims, appropriately interpreted, along with the full range of equivalents to which the claims are entitled. In the drawings, like numerals refer to the same or similar functionality throughout several views.

Figure 2:
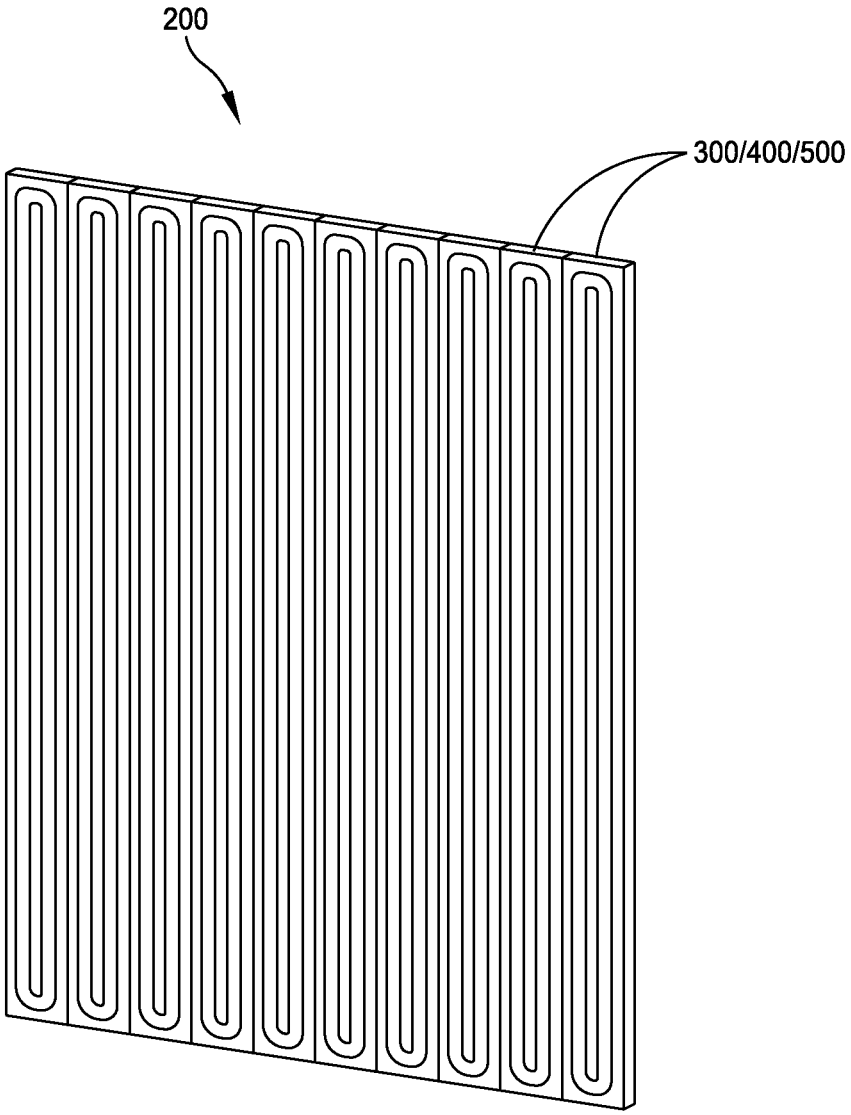
FIG. 2 is a perspective view of an exemplary embodiment of a forward coldplate assembly according to the present disclosure.

Referring generally to FIG. 2, a perspective view of an exemplary embodiment of a forward coldplate assembly 200 according to the present disclosure is shown. The forward coldplate assembly 200 comprises a composite structure formed by an array of multiple forward coldplates 300/400/500 interlockingly joined to one another. As will be set forth in greater detail below, by interlocking the forward coldplates 210 together, the faceplates used in prior art forward coldplate assemblies may be eliminated.

Figure 3A:
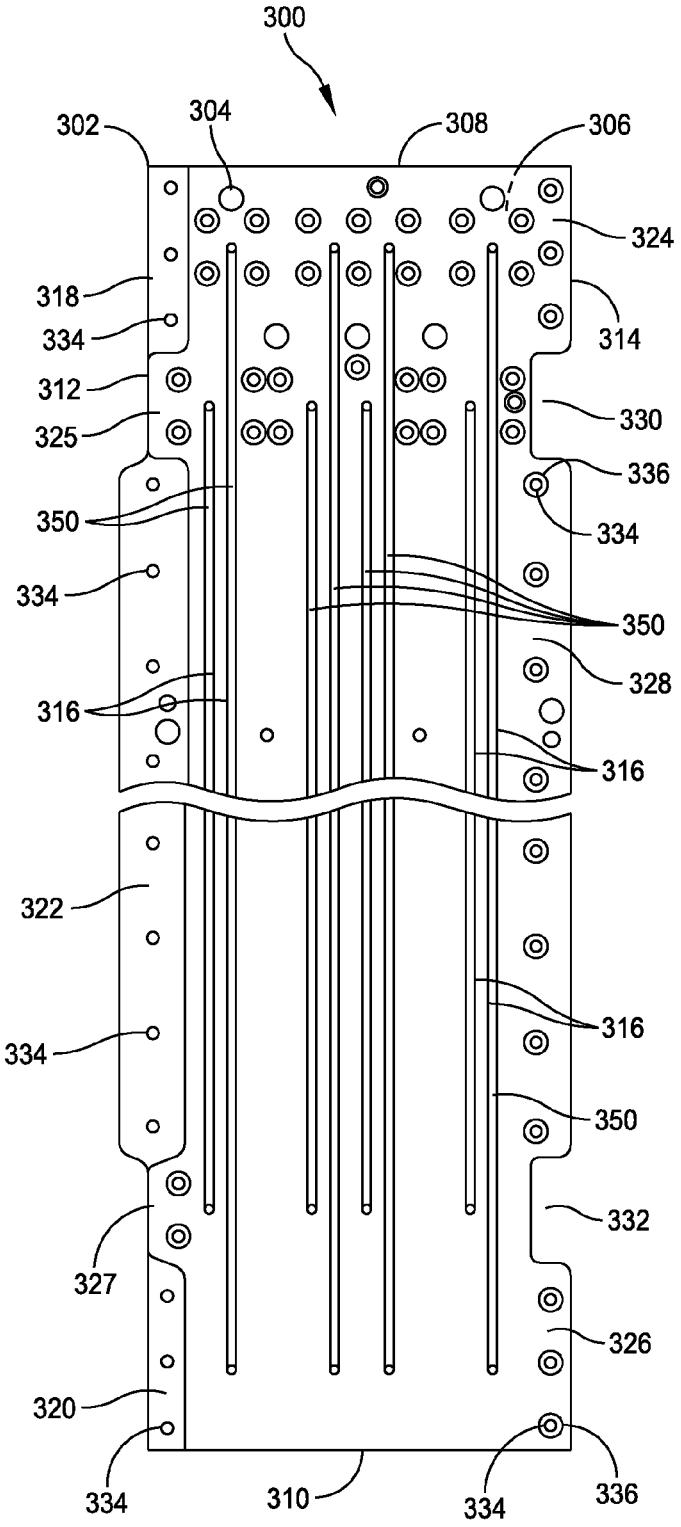
FIG. 3A is a top plan view of an exemplary embodiment of one of the forward coldplates of the forward coldplate assembly.
Figure 3B:
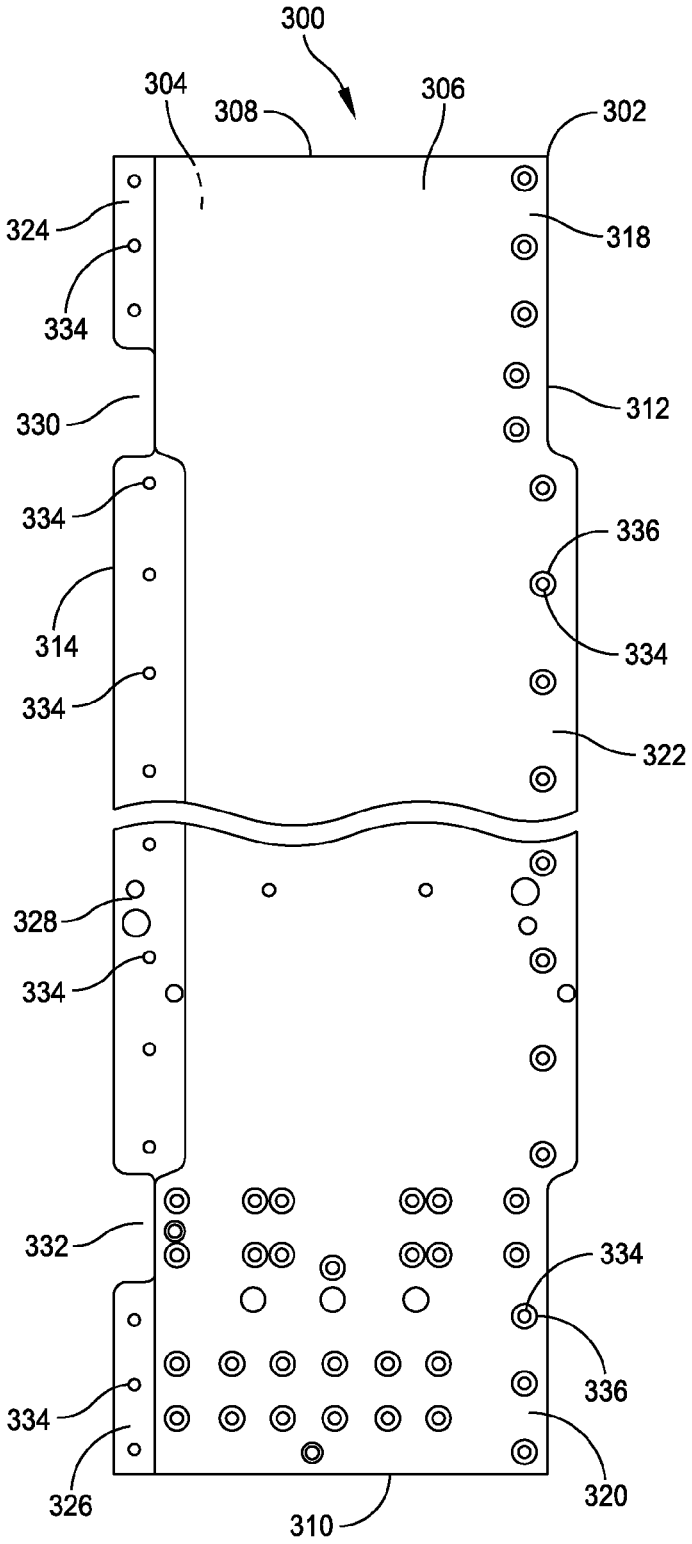
FIG. 3B is a bottom plan view of the forward coldplate of FIG. 3A.

FIGS. 3A and 3B are top and bottom plan views, respectively, of an exemplary embodiment of the forward coldplate according the present disclosure denoted generally by reference numeral 300. The forward coldplate 300 comprises an elongated body 302 having a planar upper surface 304, a planar lower surface 306, a top edge 308, a bottom edge 310, a first side edge 312, and a second side edge 314. The planar upper surface 304 of the forward coldplate 300 comprises one or more elongated trenches 316 that extend longitudinally between the top and bottom edges 308,310 of the coldplate 300. The trenches 316 are closed by covers 350.

Referring to FIG. 3A, the first side edge 312 of the forward coldplate 300 comprises a first plurality of interlocking members comprising a lower top corner rabbet 318, a lower bottom corner rabbet 320, and a lower elongated rabbet 322 disposed between the lower top and bottom corner rabbets 318,320. The lower top corner rabbet 318 is disposed at the corner of the top edge 308 and the first side edge 312 of the forward coldplate 300 and steps down from the upper surface 304 thereof. The lower bottom corner rabbet 320 is disposed at the corner of the bottom edge 310 and the first side edge 312 of the forward coldplate 300 and steps down from the upper surface 304 thereof. The lower elongated rabbet 322 projects outwardly beyond the lower top and bottom corner rabbets and steps down from the upper surface 304 of the forward coldplate 300. The portion of the upper surface 304 extending between the lower top corner rabbet 318 and the first end of the lower elongated rabbet 322 defines a top tongue 325 and the portion of the upper surface 304 extending between the lower bottom corner rabbet 320 and the second end of the lower elongated rabbet 322 defines a bottom tongue 327.

Referring to FIG. 3B, the second side edge 314 of the forward coldplate 300 comprises a second plurality of interlocking members comprising an upper top corner rabbet 324, an upper bottom corner rabbet 326, and an upper elongated rabbet 328 disposed between the upper top and bottom corner rabbets 324,326. The upper top corner rabbet 324 is disposed at the corner of the top edge 308 and the second side edge 314 of the forward coldplate 300 and steps down from the lower surface 306 thereof. The upper bottom corner rabbet 326 is disposed at the corner of the bottom edge 310 and the second side edge 314 of the forward coldplate 300 and steps down from the lower surface 306 thereof. The upper elongated rabbet 328 steps down from the lower surface 306 of the forward coldplate 300. Unlike the lower elongated rabbet 322 of the first side edge 312, which projects beyond the lower top and bottom corner rabbets, the upper elongated rabbet 328 extends the same distance as, and is flush with, the upper top and bottom corner rabbets. The portion of the lower surface 306 extending between the upper top corner rabbet 324 and the first end of the upper elongated rabbet 328 defines a top groove 330 and the portion of the lower surface 306 extending between the upper bottom corner rabbet 326 and the second end of the upper elongated rabbet 328 defines a bottom groove 332.

The corners of the rabbets, tongues and grooves may be radiused as shown in FIGS. 3A and 3B in order to facilitate assembly of the coldplate arrangement, as well as to simplify machining. One or more apertures 334 may be formed in the rabbets for receiving fasteners (e.g. threaded fasteners) which fasten the interlocking upper and lower rabbets of adjoining forward coldplates 300 to one another. The end of the aperture's opening at the upper surface 304 or the lower surface 306 of the forward coldplate 300 may be surrounded by a shallow recess or counterbore 336. The counterbore 336 allows the fastener head or nut to lie flush with its respective upper surface 304 or the lower surface 306 of the forward coldplate 300. In an alternative embodiment, the interlocking upper and lower rabbets, tongues and grooves of adjoining forward coldplates 300 can be fastened together by welding. In still other embodiments, the interlocking upper and lower rabbets, tongues and grooves of adjoining forward coldplates can be fastened together with an adhesive or with rivets, by way of non-limiting example only.

Figure 4A:
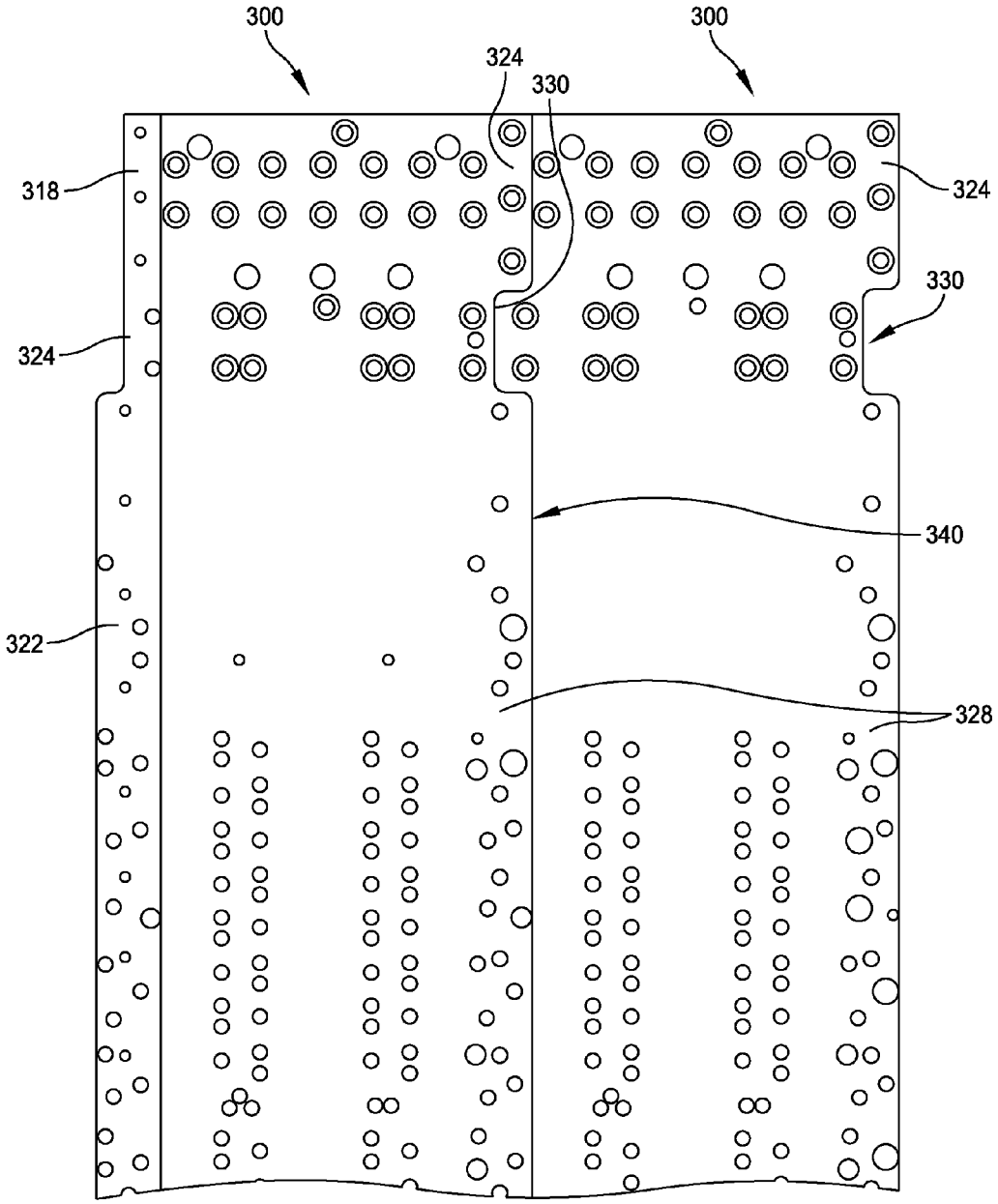
FIG. 4A is top plan view of sections of adjoining first and second forward coldplates comprising the interlocking members embodied in FIGS. 3A and 3B.

FIG. 4A is top plan view of adjoining first and second forward coldplates 300. The lower top corner rabbet 318, the lower elongated rabbet 322, and lower bottom corner rabbet 320 (not shown) of the first forward coldplate 300 respectively overlap the upper top corner rabbet 324, the upper elongated rabbet 328, and the upper bottom corner rabbet 326 (not shown) of the second forward coldplate 300 at the seam 340, thereby forming a plurality of interlocking shiplap edge joints. The top and bottom tongues 325,327 (bottom tongue 326 not shown) of the first forward coldplate 300 are respectively received in the top and bottom grooves 330,332 (bottom groove 332 not shown) of the second forward coldplate 300 at the seam 340, thereby forming a plurality of interlocking tongue and groove edge joints.

Figure 4B:
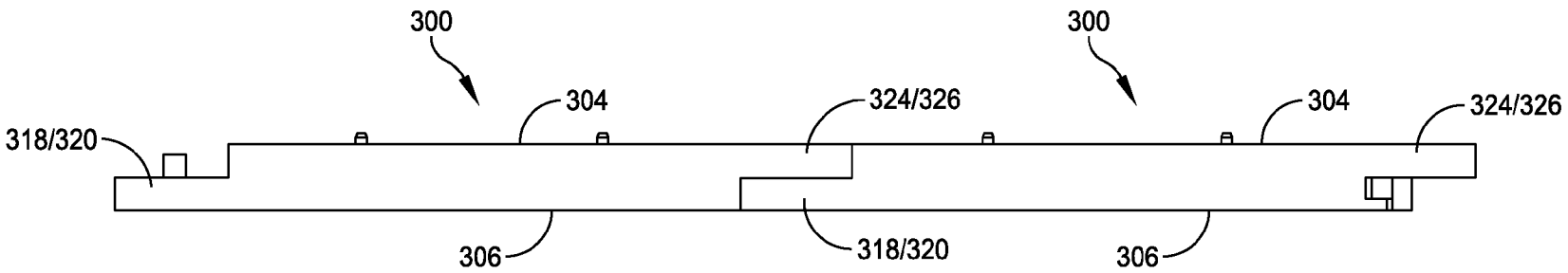
FIG. 4B is an end view of the adjoining first and second forward coldplates shown in FIG. 4A.

FIG. 4B is an end view of the adjoining first and second forward coldplates 300 of FIG. 4A, illustrating the interlocking upper rabbets 324,326 and lower rabbets 318,320. As can be seen, the upper corner rabbets 324,326 of the first forward coldplate 300 overlaps the lower corner rabbets 318,320 of the second forward coldplate 300 to form and interlocking joint.

Figure 5A:
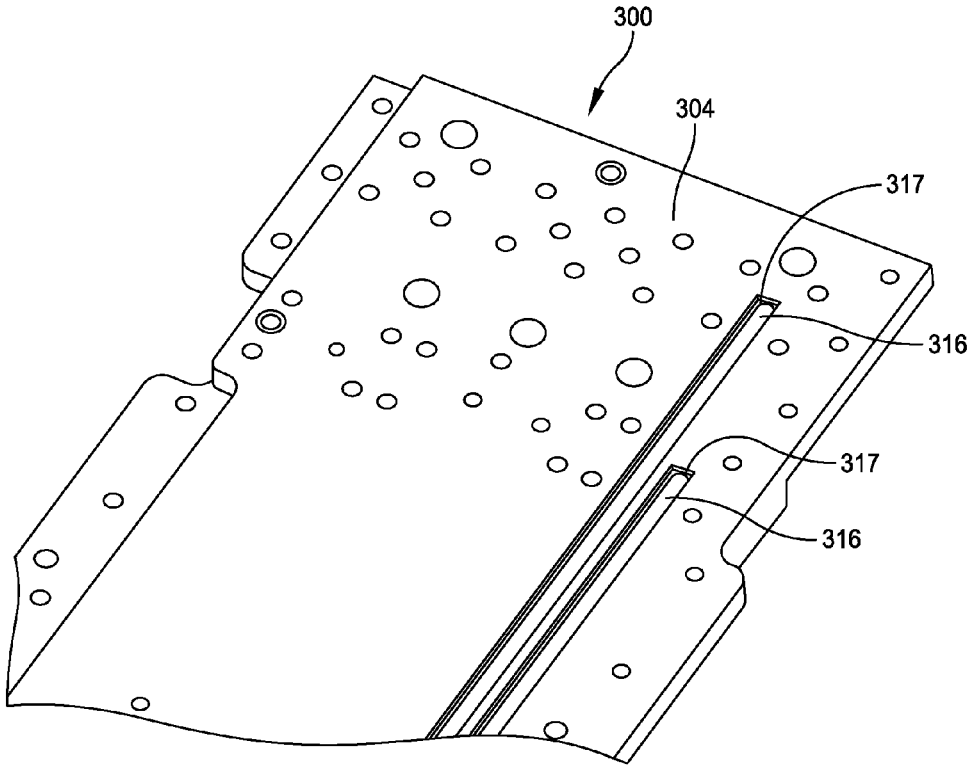
FIG. 5A is a perspective view of a section of the forward coldplate shown in FIG. 3A, illustrating one or more elongated trenches are formed in a planar upper surface of the forward coldplate.
Figure 5B:
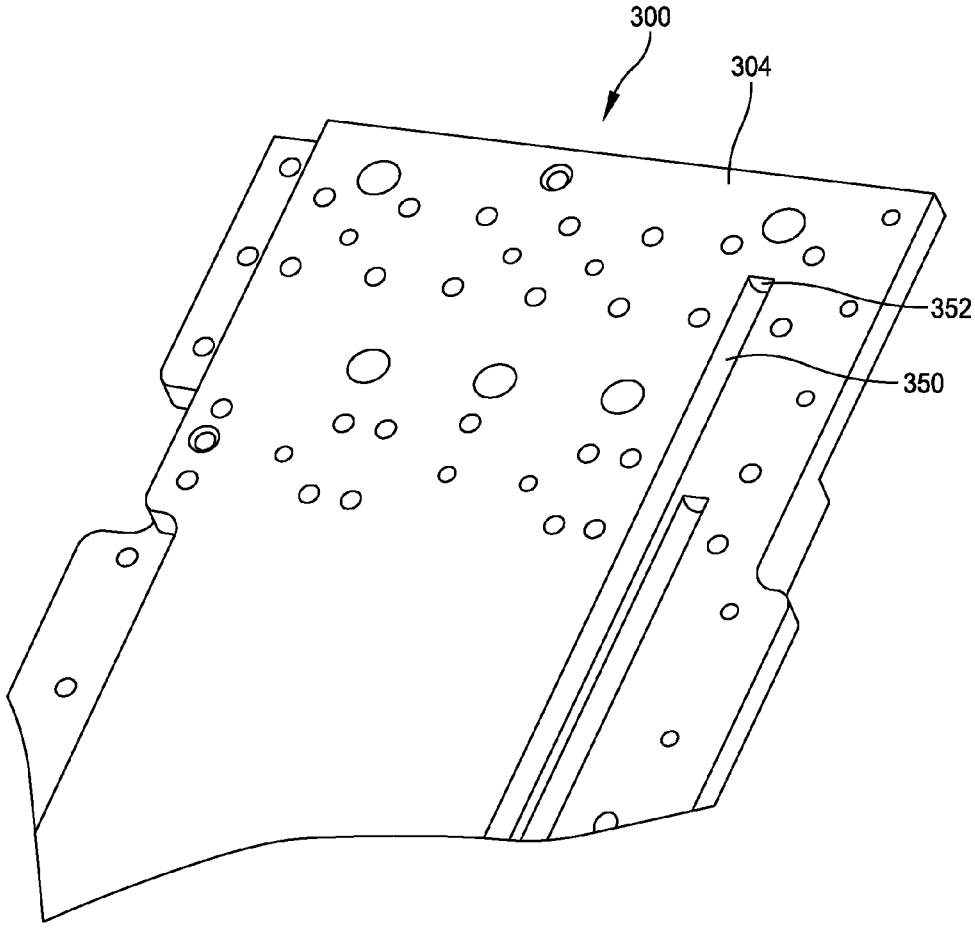
FIG. 5B is a perspective view of the section of the forward coldplate shown in FIG. 5A, illustrating elongated planar covers closing the trenches formed in the planar upper surface of the forward coldplate.

Referring to FIG. 5A, the one or more elongated trenches 316 are formed in the planar upper surface 304 of the forward coldplate 300. Each of the trenches 316 is surrounded by a shallow recess formed in the upper surface 304 of the forward coldplate 300. As shown in FIG. 5B, the elongated planar covers 350 close the trenches 316 and have coolant inlets/outlets 352 at each end thereof. Each of the covers 350 is sized to fit in the shallow recess (similar to a counterbore) surrounding its corresponding trench 316 so that the exterior surface of the cover is generally flush with the planer upper surface 304 of the forward coldplate 300. Once fitted in the shallow recesses, the covers 350 are, for example, friction-stir welded to the forward coldplates 300. Each of the inlets/outlets 352 of the trenches 316 may be placed in communication with a cooling system including, for example, a coolant reservoir and a pump arrangement, for supplying a flow of coolant through the trenches. Embodiments of the present disclosure may include, for example, an individual manifold arranged on an end of each of the coldplates 300 for operatively connecting the inlets/outlets 352 of the trenches with a cooling system. This cooling system may be specific to each manifold, such that each coldplate 300 comprises its own manifold and cooling system. In this way, each coldplate 300 may operate independently of the remaining coldplates 300 of a given system. Likewise, a plurality of manifolds may be operatively connected to a common cooling system, or a common manifold may be used to connect more than one coldplate 300 to one or more cooling systems without departing from the scope of the present invention.

Figure 5C:
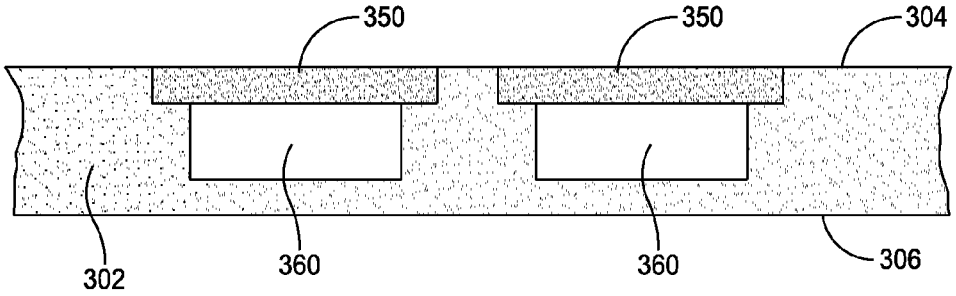
FIG. 5C is a cross-sectional view of a portion of the forward coldplate shown in FIG. 5B.

FIG. 5C is a cross-sectional view of the forward coldplate 300 shown in FIG. 5B. As shown, each cover 350 and its corresponding trench 316 defines a coolant channel 360 for circulating coolant through the forward coldplate 300 via the coolant inlet/outlet 352. The forward coldplates 300 and the covers 350 can be machined from aluminum sheet stock using for example a waterjet process. Alternatively the forward coldplates 300 and the covers 350 can stamped from aluminum sheet stock using a stamping press. The trenches 316 formed in the upper surface 304 of the forward coldplates can be made by a milling process using a computer numerical control (CNC) milling machine. The apertures 334 formed in the rabbets and tongues of the forward coldplates 300 can be formed by a drilling process using a CNC machine.

Each of the interlocking forward coldplates 300 is dimensioned to be significantly thicker and narrower than existing forward coldplates. Thickening the forward coldplates 300 significantly reduces warping incurred by friction-stir welding the covers 350 to the forward coldplates 300. In some exemplary embodiments, the interlocking forward coldplates 300 can be approximately 7" wide, approximately 108" long and approximately 0.75" thick. In other embodiments, the forward coldplates 300 can be longer than 108" (virtually as long as desired) and approximately 1.00" thick. By comparison, prior art coldplates are approximately 108" wide, approximately 60" long, and approximately 0.5" thick. Although the forward coldplate assembly 200 of the present disclosure is thicker than a similarly sized prior art forward coldplate assembly, it can weigh less than the prior art forward coldplate assembly because it eliminates the faceplate.

It should be understood that other embodiments of the forward coldplate according to the present disclosure can comprise interlocking members having more or less shiplap edge joints and/or tongue and groove edge joints than those described above in the embodiment of FIGS. 3A and 3B. In addition, some embodiments of the forward coldplate can comprise interlocking members having only shiplap edge joints formed with upper and lower rabbets (e.g., FIG. 4A) and other embodiments of the forward coldplate can comprise interlocking members having only tongue and groove edge joints formed with tongues and grooves. Further embodiments of the forward coldplate can comprise other suitable types of interlocking members for interlockingly joining the forward coldplates of the forward coldplate assembly 200 to one another.

Figure 6A:
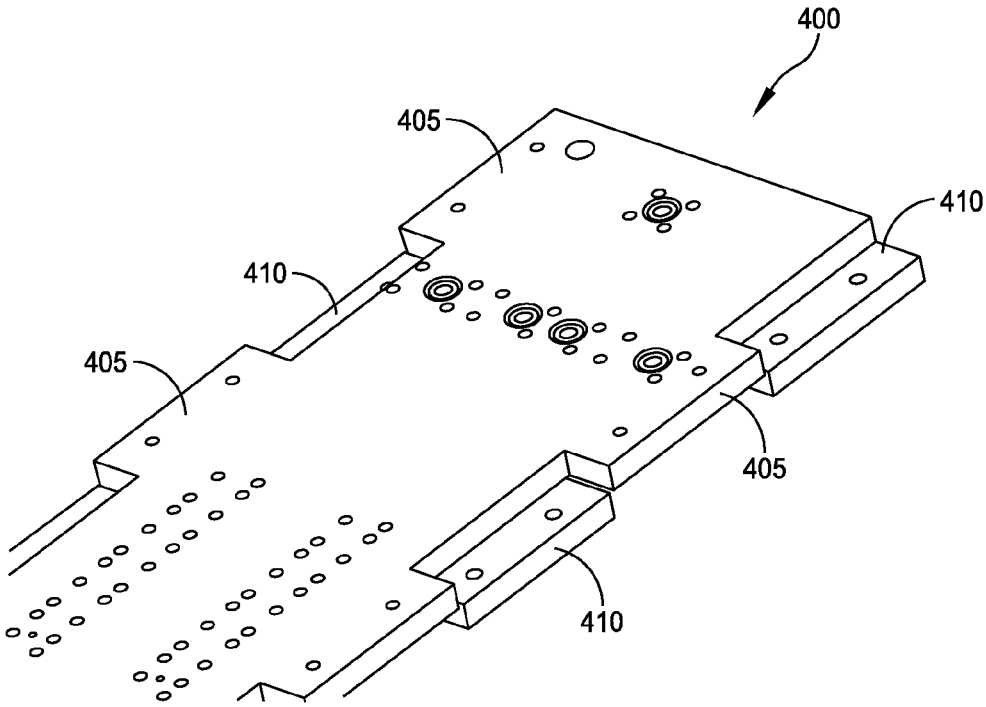
FIG. 6A is perspective view of a section of a forward coldplate according to another exemplary embodiment of the present disclosure.
Figure 6B:
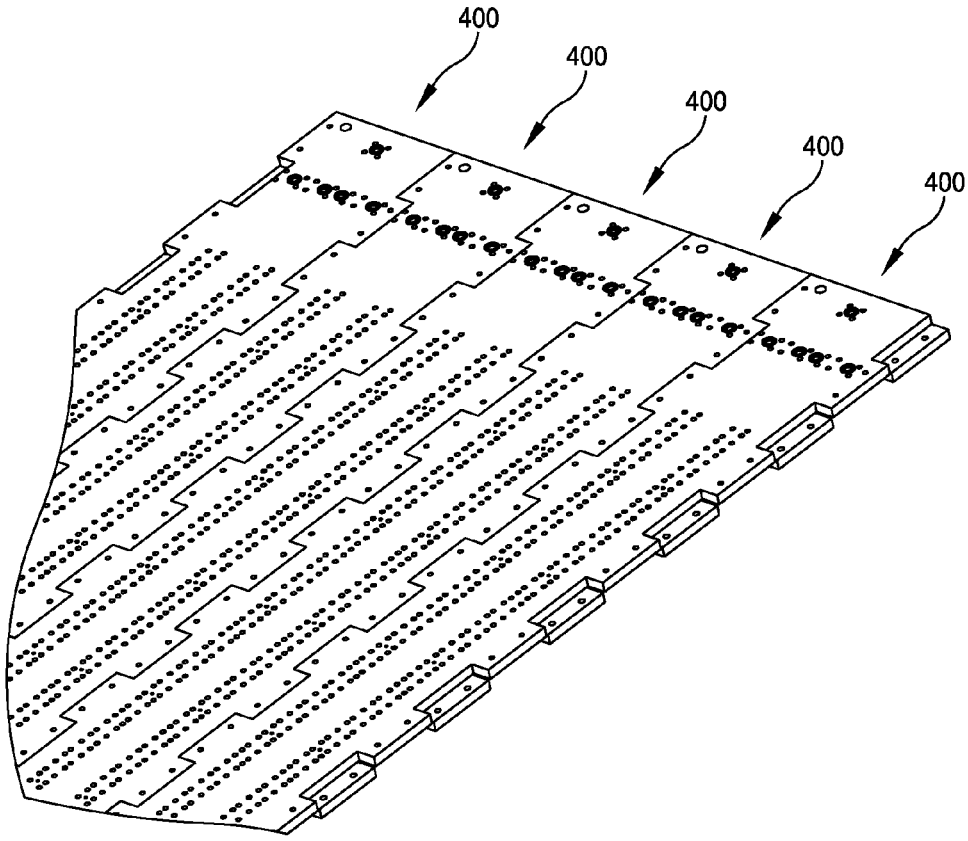
FIG. 6B is a perspective view showing a section of a plurality of the forward coldplates of FIG. 6A interlockingly joined to one another in an array.

For example, FIG. 6A is perspective view of another exemplary embodiment of the forward coldplate of the present disclosure denoted generally by reference numeral 400. The forward coldplate 400 is similar to the forward coldplate 300 described earlier, however, the plurality of interlocking members comprise first and second pluralities of alternating upper and lower rabbet members 405,410. In order to allow adjoining forward coldplates 400 to be interlockingly joined to one another, the upper rabbet members 405 on one side edge of the forward coldplate 400 are disposed opposite to the lower rabbet members 410 on the other side edge of the forward coldplate 400. FIG. 6B is a perspective view showing a plurality of the forward coldplates 400 of FIG. 6A interlockingly joined to one another.

Figure 7:
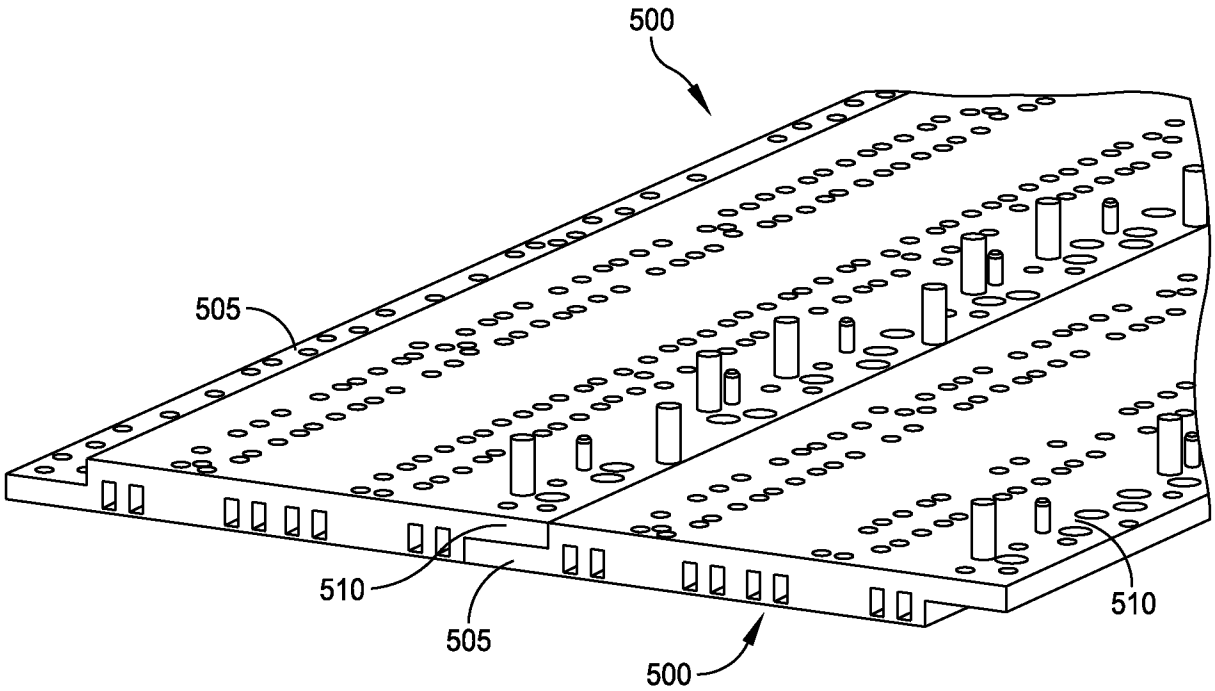
FIG. 7 is a perspective view of a section of a forward coldplate according to a further embodiment of the present disclosure.

FIG. 7 is a perspective view of a further exemplary embodiment the forward coldplate denoted generally by reference numeral 500. The forward coldplate 500 is similar to the forward coldplates 300,400 described earlier, however, the plurality of interlocking members comprise a single elongated lower rabbet 505 formed on one side edge of the forward coldplate 500 and a single elongated upper rabbet 510 formed on the other side edge of the forward coldplate 500.

Further, embodiments of the coldplates described herein may comprise the ability to interlock with other coldplates along any of their edges, rather than just their sides as illustrated. For example, coldplate 300 of FIGS. 3A and 3B may comprise one or more rabbets formed along the top and/or bottom edges 308,310 for interlocking with a corresponding rabbet formed on another coldplate (i.e. a corresponding rabbet formed on the other one of the top and/or bottom edges of another coldplate). In this way, a coldplate assembly according to embodiments of the preset invention may be expanded both laterally, as well as vertically. This added flexibility allows embodiments of the present invention to be implemented into a wide variety of applications having differing size requirements.

This modularity may be especially applicable in the field of radar systems, wherein antenna arrays may be implemented in standardized sizes. A common modular coldplate arrangement according to embodiments of the present invention may be used in each of these systems, wherein construction of larger arrays requires the use of additional coldplate assemblies added to the system. It is further envisioned that some or all of the radar array (e.g. the array antenna radiators and accompanying array electronics), may be constructed in a similarly modular fashion, wherein the coldplates, the system electronics, and the antenna members may comprise common building blocks used to form arrays of a plurality of sizes.

Although the forward coldplate assemblies have been described in terms of exemplary embodiments, it is not limited thereto. Rather, the appended claims should be construed broadly, to comprise other variants and embodiments of the forward coldplate assembly, which may be made by those skilled in the art without departing from the scope and range of equivalents of the apparatus and its elements.

What is claimed is:

1. A method for making a coldplate assembly of a phased array antenna, the method comprising:

providing a first coldplate having one or more internal coolant channels and one or more interlocking members disposed at an edge of the first coldplate;

providing a second coldplate having one or more internal coolant channels and one or more interlocking members disposed at an edge of the second coldplate; and engaging the one or more interlocking members of the first coldplate with the one or more interlocking members of the second coldplate to interlock the first coldplate with the second coldplate.

2. The method of claim 1, wherein the first and second coldplates are elongated.

3. The method of claim 1, wherein the one or more interlocking members of the first and second coldplates respectively comprise at least one tongue and at least one groove.

4. The method of claim 1, wherein the one or more interlocking members of the first and second coldplates respectively comprise at least one upper rabbet and at least one lower rabbet.

5. The method of claim 1, wherein the one or more interlocking members of the first coldplate comprises at least one upper or lower rabbet and at least one tongue or groove and wherein the one or more interlocking members of the second coldplate comprises at least one corresponding lower or upper rabbet and at least one corresponding groove or tongue.

6. The method of claim 1, further comprising the step of fastening the one or more interlocking members of the first coldplate engaged with the one or more interlocking members of the second coldplate with fasteners, adhesive or welds.

7. A coldplate assembly for a phased array antenna, the coldplate assembly comprising:

a first coldplate having one or more internal coolant channels and one or more interlocking members disposed at an edge of the first coldplate; and a second coldplate having one or more internal coolant channels and one or more interlocking members disposed at an edge of the second coldplate;

wherein the one or more interlocking members of the first coldplate interlock with the one or more interlocking members of the second coldplate.

8. The coldplate assembly of claim 7, wherein the first and second coldplates are elongated.

9. The coldplate assembly of claim 7, wherein the one or more interlocking members of the first and second coldplates respectively comprise at least one tongue and at least one groove.

10. The coldplate assembly of claim 7, wherein the one or more interlocking members of the first and second coldplates respectively comprise at least one upper rabbet and at least one lower rabbet.

11. The coldplate assembly of claim 7, wherein the one or more interlocking members of the first coldplate comprises at least one upper or lower rabbet and at least one tongue or groove and wherein the one or more interlocking members of the second coldplate comprises at least one corresponding lower or upper rabbet and at least one corresponding groove or tongue.

12. The coldplate assembly of claim 7, further comprising fasteners, adhesive or welds for fastening the one or more interlocking members of the first coldplate interlocked with the one or more interlocking members of the second coldplate.

13. A phased array antenna comprising:

a coldplate assembly comprising:

a first coldplate having one or more internal coolant channels and one or more interlocking members disposed at an edge of the first coldplate;

a second coldplate having one or more internal coolant channels and one or more interlocking members disposed at an edge of the second coldplate, the one or more interlocking members of the first coldplate interlocking with the one or more interlocking members of the second coldplate; and an antenna array disposed a first side of the coldplate assembly.

14. The phased array antenna of claim 13, wherein the first and second coldplates are elongated.

15. The phased array antenna of claim 13, wherein the one or more interlocking members of the first and second coldplates respectively comprise at least one tongue and at least one groove.

16. The phased array antenna of claim 13, wherein the one or more interlocking members of the first and second coldplates respectively comprise at least one upper rabbet and at least one lower rabbet.

17. The phased array antenna of claim 13, wherein the one or more interlocking members of the first coldplate comprises at least one upper or lower rabbet and at least one tongue or groove and wherein the one or more interlocking members of the second coldplate comprises at least one corresponding lower or upper rabbet and at least one corresponding groove or tongue.

18. The phased array antenna of claim 13, further comprising one or more fasteners, adhesives, or welds for fastening the one or more interlocking members of the first coldplate interlocked with the one or more interlocking members of the second coldplate.

* * * * *